US006856340B2

(12) United States Patent
Morrison et al.

(10) Patent No.: US 6,856,340 B2
(45) Date of Patent: Feb. 15, 2005

(54) SYSTEM AND METHOD FOR CLOCK INDEPENDENT PULSE WIDTH MODULATION

(75) Inventors: Robert D. Morrison, Star, ID (US); Jack L. Meador, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 28 days.

(21) Appl. No.: 10/353,687

(22) Filed: Jan. 28, 2003

(65) Prior Publication Data

US 2004/0145649 A1 Jul. 29, 2004

(51) Int. Cl.[7] ..... B41J 2/47
(52) U.S. Cl. ..... 347/255; 347/239
(58) Field of Search ..... 347/239, 240, 347/251, 252, 255, 235, 250, 133, 144; 358/1.15

(56) References Cited

U.S. PATENT DOCUMENTS

| | | | | | |
|---|---|---|---|---|---|
| 5,081,477 | A | * | 1/1992 | Gibson | 347/133 |
| 5,546,355 | A | | 8/1996 | Raatz et al. | 365/233 |
| 6,014,161 | A | * | 1/2000 | Hirst et al. | 347/252 |
| 6,191,865 | B1 | * | 2/2001 | Takahashi | 358/1.15 |
| 6,366,307 | B1 | | 4/2002 | Morrison | 347/249 |

* cited by examiner

*Primary Examiner*—Hai Pham

(57) ABSTRACT

A method of clocking a video processing circuit is performed by stalling a reference clock signal. The reference clock signal is stalled based on a stall signal from a clock-independent pulse width modulator. The stalled reference clock signal is used to produce a video clock signal for use by an image data processing circuit.

43 Claims, 5 Drawing Sheets

SYSTEM AND METHOD FOR CLOCK INDEPENDENT PULSE WIDTH MODULATION

BACKGROUND

When producing hardcopy images using a laser printer, a latent image is first created on the surface of an insulating, photo-conducting material. This photo-conducting material is usually formed into a rotating drum. The insulating, photo-conducting material is made conductive when and where it is exposed to light.

Data, which defines the image to be printed, is used to modulate a laser that is scanned over the surface of the drum, line-by-line. A field of charges is applied over the surface of the drum. By selectively exposing areas on the surface of the drum with the laser, the charge in the exposed area is dissipated. This creates the latent image in the charge field on the drum that corresponds to the image represented by the data used to modulate the laser.

The latent image on the drum is then developed. A charged toner is applied to the surface of the drum. Because the toner is charged, the toner will be attracted to the latent image on the drum and repelled by other, unexposed portions of the drum surface. Thus, the latent image on the drum is developed and becomes a toner image on the drum surface.

The toner image is then transferred from the drum to a print medium, such as a sheet of paper. The toner is then fixed or fused to the print medium, typically with heat. The result is a hardcopy document bearing the image that corresponds to the data used to modulate the laser.

As used herein, the term "print engine" includes the devices used to actually produce a desired hardcopy document. Thus, a laser print engine includes, for example, a laser, a photoconductive drum, a transfer roller, laser modulation circuitry, the image data processing circuitry, etc. The speed at which a laser printer may print is limited mostly by the characteristics and physical mechanics of the print engine, i.e., the processing speed of the circuitry and the motion of the mechanical parts.

Within the data used to define the image being printed, the image is broken down into pixels. Each pixel is a small portion of the image. The pixels are arranged in successive lines to form the image. In monochromatic laser printing, each pixel is associated with a particular darkness or brightness along a grayscale. If a pixel is to be completely dark, then a maximum amount of black toner should be applied to that pixel during printing. Conversely, if the pixel is to be completely light, then no toner should be applied. In between these two extremes, varying amounts of toner are applied to produce various shades of gray.

The amount of toner applied within a pixel will be determined by how much of that pixel's area on the photo-conducting drum is exposed by the laser. By placing toner in only a varying portion of a pixel region, it is possible to create the effect of various shades of gray for each pixel and improve the resolution of the resulting image. Consequently, the laser can be pulsed for a selective amount of time within each pixel as it is scanned across each line of the image. The method of selectively pulsing the laser as described above is referred to as pulse width modulation (PWM).

To coordinate operations, complex devices, such as a laser printer, use clock signals. A laser printer can use two separate clock signals, a system clock and a video clock. The system clock regulates the operation of the data processing elements of the printer, e.g., the central processing unit (CPU) and memory. The system clock runs at a speed defined by processor performance. The video clock regulates the transfer of video data in synchronization with the operation of the print engine. The video clock may be a fixed-frequency crystal oscillator with a frequency that is selected to match the performance speed of the print engine. In other words, the period of the video clock is influenced by the physical mechanics, characteristics and limitations of the elements of the print engine. By choosing an appropriate video clock frequency, the transfer of video data is synchronized with the operation of the print engine.

However, using two unrelated clocks can cause other issues. First, delays may occur when data is transferred from the processor to the video circuitry of the print engine. Second, ASIC (Application Specific Integrated Circuit) design and testing for use in a printer is significantly hampered due to the difficulty of communicating using two different clock domains. Third, ASIC's designed for one print engine may have difficulty functioning with another print engine, thereby limiting the ability to reuse the ASIC in future laser printer development. Implementations that make use of a single clock, such as the system clock, for performing the functions of regulating the operation of the data processing elements of the printer and regulating the transfer of video data in synchronization with the operation of the print engine can encounter difficulties in dividing down the system clock for use by the video pixel generation circuitry.

SUMMARY

In one of many possible embodiments, the present invention provides a method and system for clocking a video processing circuit by stalling a reference clock signal based on a stall signal from a clock-independent pulse width modulator.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

Due to the issues that arise when two independent clock signals are used in a printing device, clock-independent pulse width modulation (CIPWM) was developed. See U.S. Pat. No. 6,366,307, issued on Apr. 2, 2002 to Morrison, entitled "Clock independent pulse width modulation," and incorporated herein by reference. See also, U.S. Pat. No. 5,438,353, issued Aug. 1, 1995 to Morrison, entitled "Clock signal generator for electrophotographic printers;" and U.S. Pat. No. 5,760,816, issued Jun. 2, 1998 to Morrison, entitled "Variable phase clock generator for an electrophotographic printer," both of which are incorporated by reference in their respective entireties. CIPWM makes it possible to use only one clock for the entire printing system, instead of two clocks.

CIPWM uses only a system clock and not a video clock. Instead of using a video clock to time data transfers, a circuit calculates when video data is needed and should be transferred. In particular, the CIPWM circuit generates a desired video signal by computing pulse edge offsets from the start of a scan line, i.e., the line through which a laser moves. In this way the CIPWM circuit determines at which system clock cycles to transmit video data from the processor to the video circuitry of the print engine and determines the placement of pixel boundaries.

In operation, CIPWM supplies video data during specific system clock cycles, and not at others instead of transferring data every clock cycle. Due to the erratic timing of the CIPWM technique, there is no practical way to slow down or divide down a system clock signal for the video pixel generation circuitry. Consequently, existing laser printer circuitry may be widely incompatible with the CIPWM technique.

Consequently, a method and system will be described herein for incorporating Clock Independent Pulse Width Modulation (CIPWM) with existing video processing circuitry used in laser printing. By clock gating, i.e., manipulating the clock signal, a system clock used for data processing in a laser printer may also function to drive the video image circuitry of the laser print engine.

As described above, laser printer technology has traditionally used two separate clocks, a system clock and a video clock, to drive the laser printer circuitry. The clock period of the video clock, the clock that runs the video image circuitry of the print engine, is determined by the operational speed of the print engine. In contrast, the system clock runs at a speed determined by the processor performance speed of the data processing elements of the printer, e.g., a central processor and memory.

Figure 1:
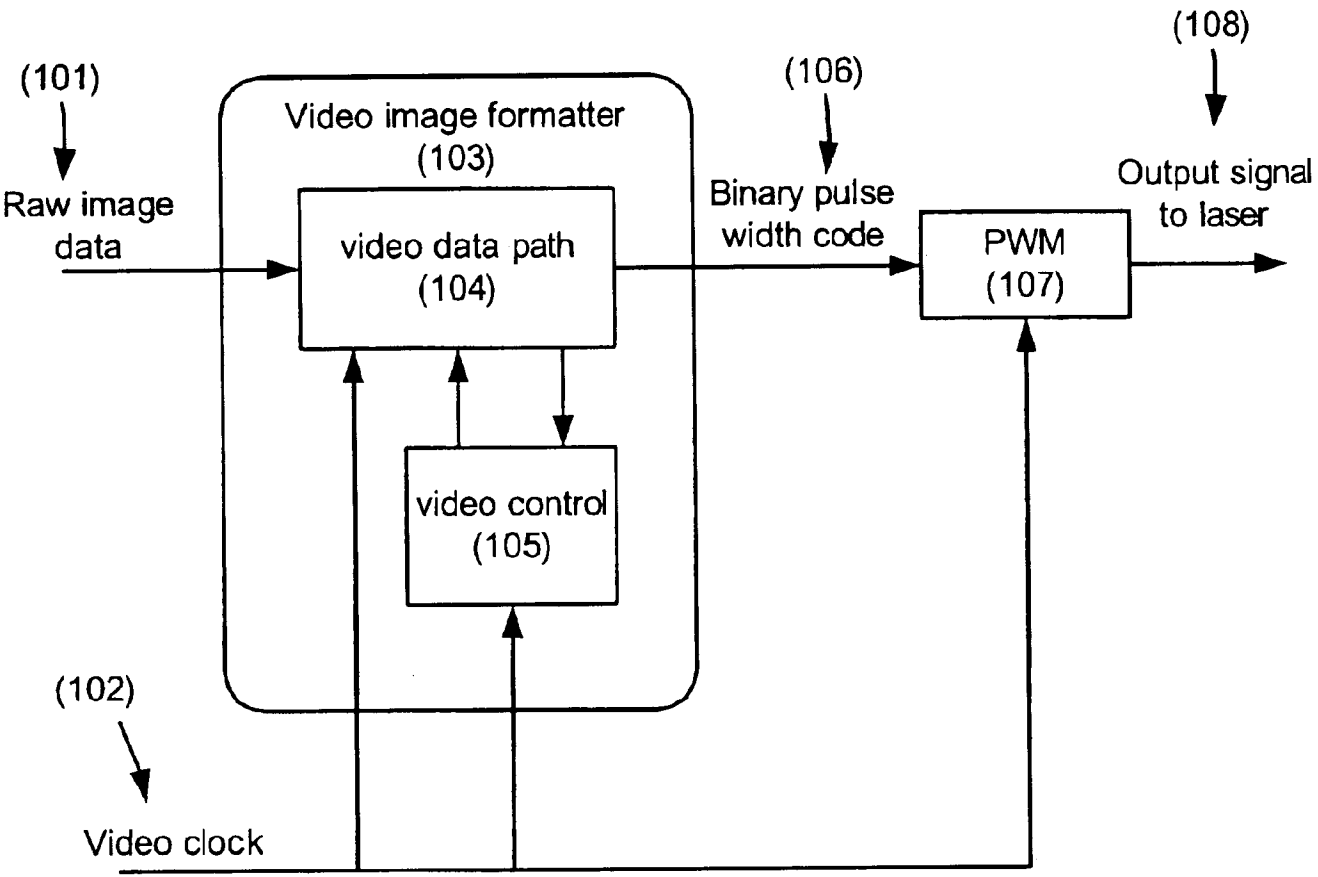
FIG. 1 is a block diagram illustrating an embodiment of a video processing circuit used for laser printing.

FIG. 1 is a block diagram illustrating an embodiment of a video processing circuit that may be used for laser printing. As shown in FIG. 1, raw image data (101) is input to a video data path (104) of a video image formatter (103). The video image formatter (103) uses a video control block (105) to convert the raw image data (101) to a corresponding binary pulse width code (106). This binary pulse width code (106) is sent through the video data path (104) and output to a pulse width modulator (PWM) (107), which consumes one pulse code (106) every video clock (102) period. The PWM (107) outputs a control signal (108) to a laser.

Elements of the video processing circuit, including, the video data path (104), the video control block (105), and PWM (107), are driven by a video clock (102). The video clock (102), enables the video processing circuit to operate the laser at a speed synchronized with the physical movements of laser print engine.

Figure 2:
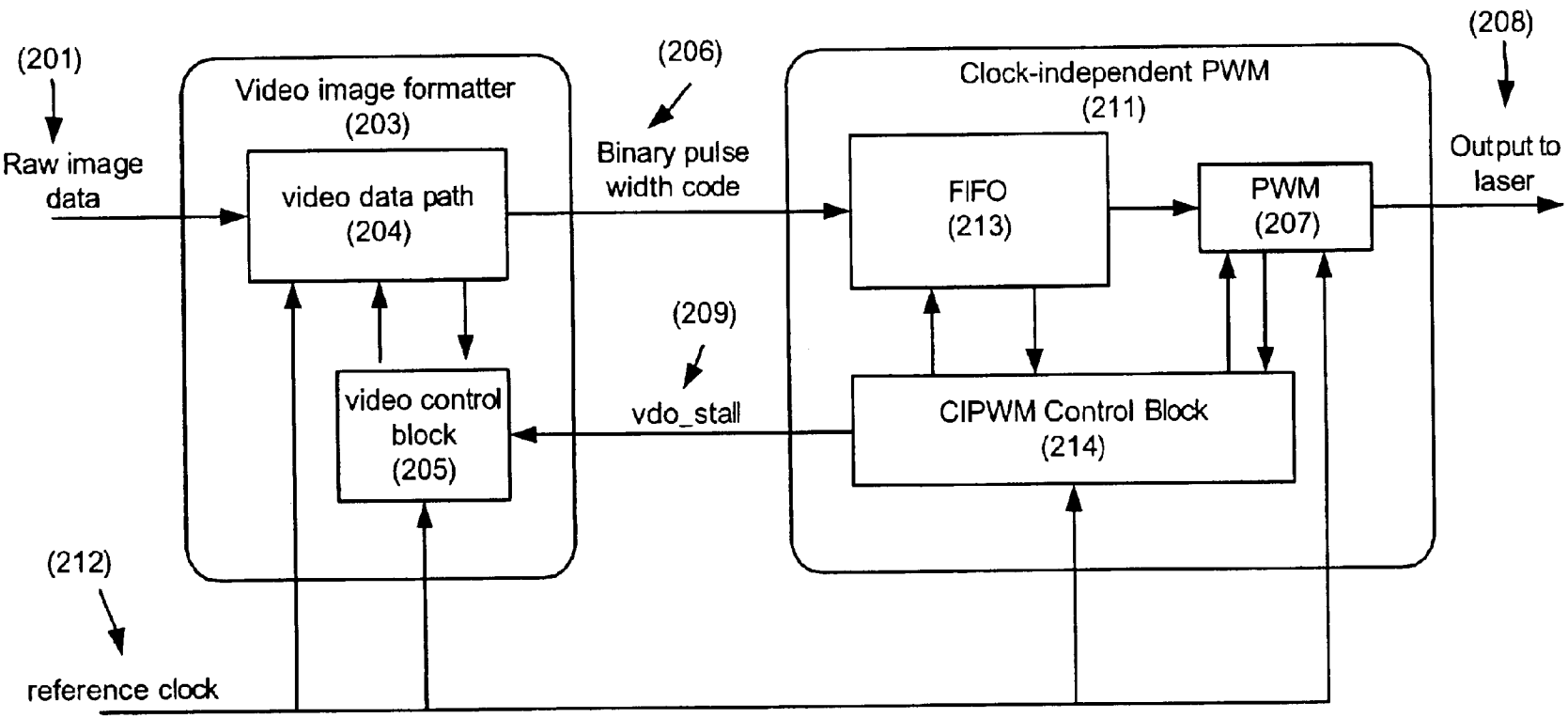
FIG. 2 is a block diagram illustrating an embodiment of a video processing circuit for laser printing using CIPWM without clock gating.

FIG. 2 is a block diagram illustrating an embodiment of a video processing circuit for laser printing using a CIPWM without clock gating. As shown in FIG. 2, the video image formatter (203) performs the function of converting raw image data (201) into a binary pulse width code (206). This is accomplished by stepping the raw image data (201) through a video data path (204) to a video control block (205), where the raw image data (201) is converted to a binary pulse width code (206). The binary pulse width code (206) is then stepped through the video data path (204) and output to the CIPWM modulator (211).

The CIPWM modulator (211) enables the video processing circuitry of FIG. 2 to use a reference clock (212) rather than a video clock (101, FIG. 1). The reference clock (212) is preferably a fixed period source obtained from the system clock, i.e., the processor unit clock, of a laser printer. In operation, the CIPWM modulator (211) receives the binary pulse width code (206) using a FIFO (first-in, first-out) circuit (213). The FIFO (213) passes the binary pulse width codes (206) on to a PWM (207) and a CIPWM control block (214) in the order they are received.

The CIPWM control block (214) interacts with the FIFO (213) and the PWM (207) to coordinate the modulation of a laser used for laser printing. More specifically, the CIPWM control block (214) uses the reference clock (212) and the binary pulse width codes (206) being stacked in the FIFO (213) to determine a "synthesized" pixel rate at which to consume the binary pulse width codes (206).

In accordance with the synthesized pixel rate, the CIPWM modulator (211) produces a vdo_stall signal (209) which allows the video control block (205) to pace the video data path (204) such that binary pulse width codes are emitted only when the CIPWM modulator (211) needs them (as determined by the synthesized pixel rate).

The video control block (205) used with a CIPWM modulator (211) is different than the video control block (105, FIG. 1) used in a traditional video image formatter (103, FIG. 1). More specifically, the video control block (205) of FIG. 2 must be specifically designed to allow an incoming signal, e.g., vdo_stall (209), to pace the transfer of data within the video data path (204), whereas a traditional video control block (103, FIG. 1) transfers data every clock cycle.

Figure 3:
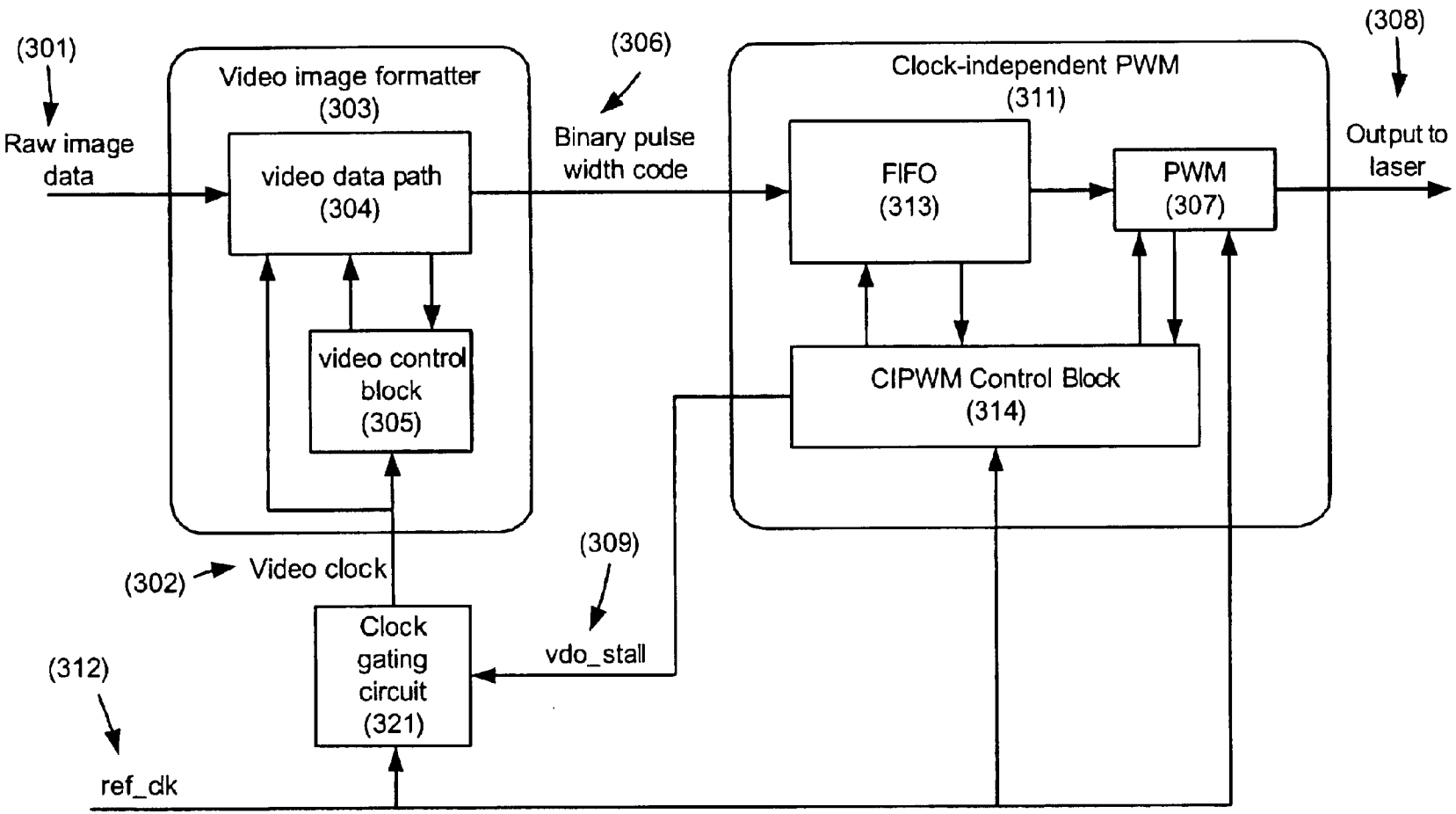
FIG. 3 is a block diagram illustrating a video processing circuit for laser printing using CIPWM with clock gating according to an embodiment of the present invention.

FIG. 3 is a block diagram illustrating an embodiment of a video processing circuit for laser printing using a CIPWM modulator with clock gating. The video processing circuit shown in FIG. 3 is similar to the video processing circuit of FIG. 2, and both circuits allow modulation of a laser for laser printing using a CIPWM modulator (311, FIG. 3; 211, FIG. 2). In accordance with one embodiment of the pre circuitry of FIG. 3 uses a clock gating circuit (321) to pace the video clock (302) used by the video data path (304) and video control block (305) of the video image formatter (303).

In operation, the clock gating circuit (321) receives a reference clock signal (312), preferably based on a system (processor) clock, and a vdo_stall signal (309) from the CIPWM control block (314) of the CIPWM modulator (311). The output signal, video clock (302), allows the video image formatter (303) to output binary pulse width code (306) only when the CIPWM modulator (311) needs the data. The remaining operation of the video processing circuit of FIG. 3 is similar to the video processing circuit of FIG. 2.

By using a clock gating circuit (321) to effectively stall the clocking of the video image formatter (303) in accordance with the operation of the CIPWM modulator (311), the video control block (305) may be used without modification, i.e., existing video control ASIC's (Application Specific Integrated Circuits) may be used with CIPWM technology. This is in contrast to the video processing circuit of FIG. 2, in which video control block (205)

would be modified so that it is capable of manipulating a reference clock signal (212) according to a vdo_stall signal (209) from the CIPWM modulator (211) for proper operation.

The cost and design benefits of using existing video control circuitry (305, FIG. 3) coupled with a relatively simple clock gating circuit (321, FIG. 3), rather than designing a new video control block (205, FIG. 2) as is the case for the original CIPWM system of FIG. 2, are potentially enormous.

Figure 4:
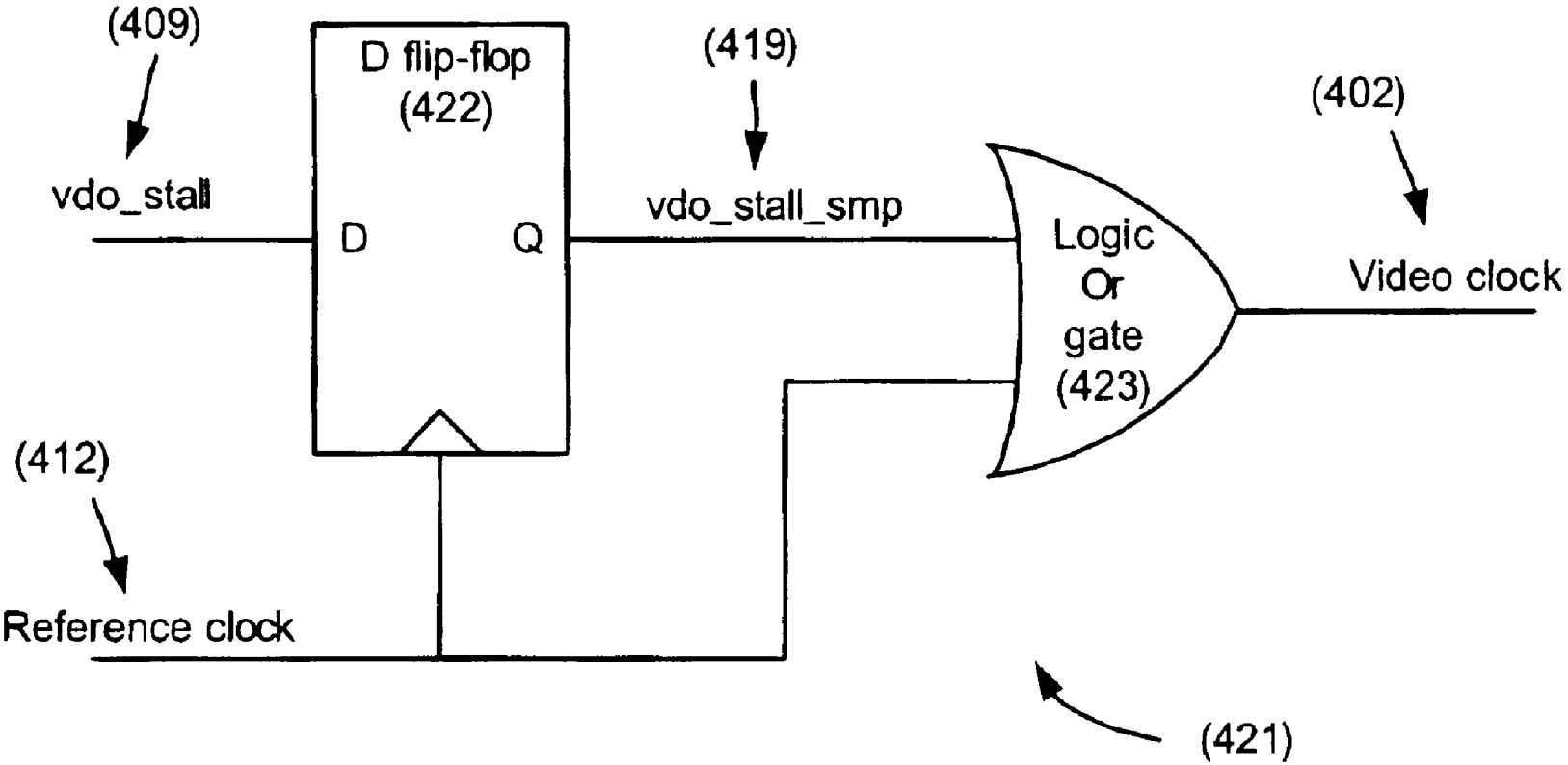
FIG. 4 is a block diagram illustrating a clock gating circuit according to an embodiment of the present invention.

FIG. 4 is a block diagram illustrating an embodiment of a clock gating circuit (e.g., 321, FIG. 3). As shown in FIG. 4, a D flip-flop (422) and a logic OR gate (423) may be used as a clock gating circuit (421) according to one embodiment of the present invention. The D flip-flop (422) receives two input signals, vdo_stall (409) and a clock signal, i.e., reference clock (412). Using these two input signals, the D flip-flop (422) outputs one signal, vdo_stall_smp (419). In operation of the D flip-flop (422), the value of vdo_stall (409) at the rising edge of each clock period of reference clock (412) is output and maintained for the duration of each clock period of the reference clock (412). There is also a propagation delay, wherein the output of the D flip-flop occurs a brief time after the transition of the reference clock signal (412) from logic "0" to "1" occurs.

As shown in FIG. 4, the logic OR gate (423) receives as input, reference clock (412) and vdo_stall_smp (419), and outputs video clock (402). The operation of the logic OR gate (423) is described below in Table 1.

TABLE 1

| Vdo_stall_smp (419) (Input) | Reference clock (412) (Input) | Video clock (402) (Output) |
|---|---|---|
| 0 | 0 | 0 |
| 0 | 1 | 1 |
| 1 | 0 | 1 |
| 1 | 1 | 1 |

As shown in Table 1, the value of video clock (204) is logic "0" when both vdo_stall_smp (419) and reference clock (412) are both logic "0." Any other combination of logic values for vdo_stall_smp (419) and reference clock (412) results in a logic "1" value for video clock (402).

Figure 5:
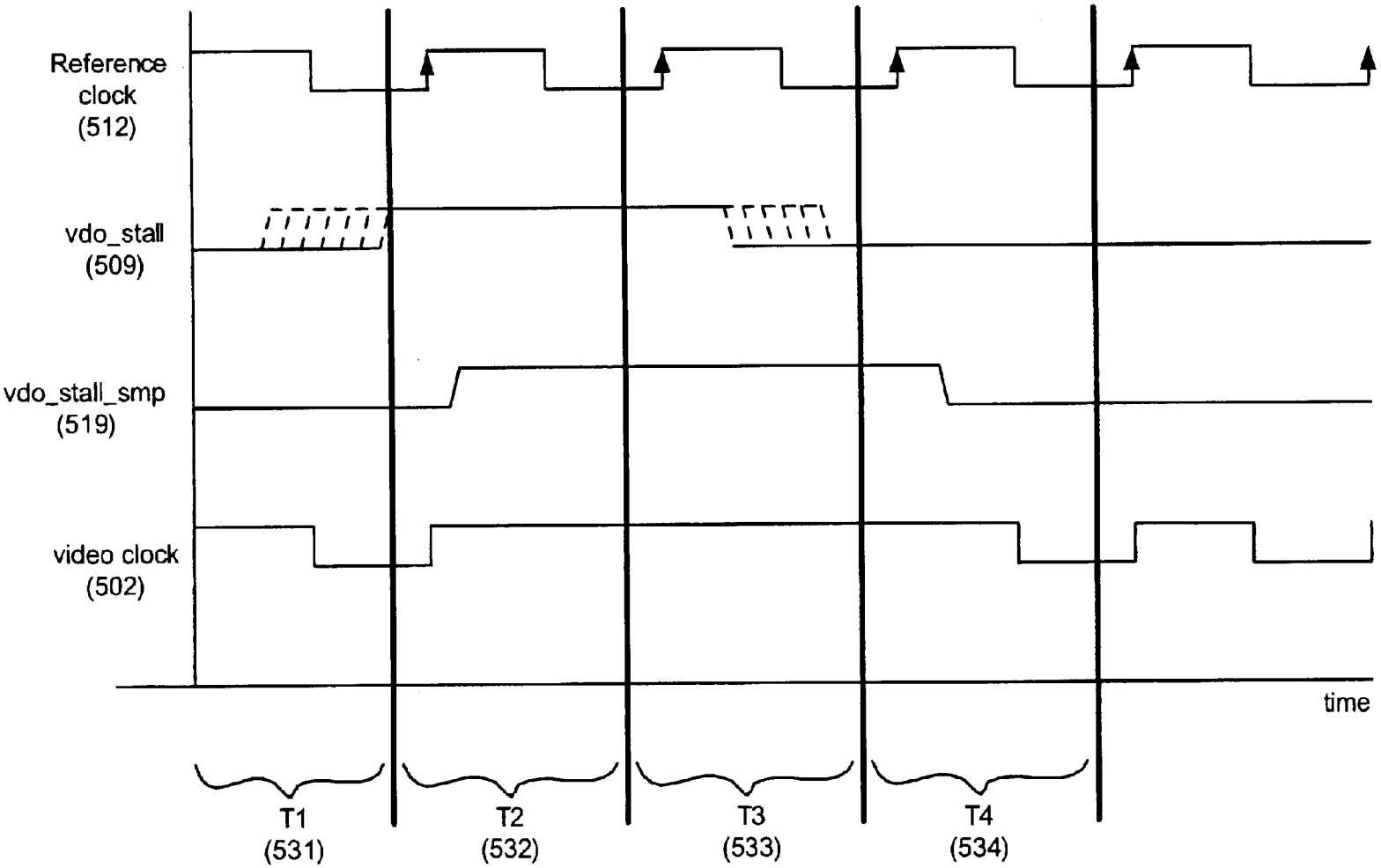
FIG. 5 is a timing diagram illustrating the functionality of a clock gating circuit according to an embodiment of the present invention.

FIG. 5 is a timing diagram illustrating the functionality of a clock gating circuit as described herein. More specifically, FIG. 5 shows a timing diagram illustrating the operation of the clock gating circuit of FIG. 4. As shown in FIG. 5, the signals, reference clock (512), vdo_stall (509) vdo_stall_smp (519), and video clock (502) are represented.

During the time period T1 (531), reference clock (512) starts high and goes low, vdo_stall (509) is activated, i.e., a "high" is sent from the CIPWM modulator (311, FIG. 3) to the clock gating circuit (321, FIG. 3), vdo_stall_smp (519) remains in a low state, and reference clock (512).

In time period T2 (532), reference clock (512) continues clocking at a fixed frequency, vdo_stall (509) remains in a high state, vdo_stall_smp (519) moves to a high state after a delay through a D flip-flop (422, FIG. 4), and video clock (502) switches to a high state.

In time period T3 (533), reference clock (512) continues clocking at a fixed frequency, $vdo_{13}$ stall (509) is deactivated by the CIPWM modulator (311, FIG. 3), vdo_stall_smp (519) remains in a high state, and video clock (502) remains in a high state.

In time period T4, (534), reference clock (512) continues clocking at a fixed frequency, vdo_stall (509) remains in a low state, vdo_stall_smp (519) changes to a low state after a delay through a D flip-flop (422, FIG. 4), and video clock (502) begins to mirror the reference clock (512) again.

As shown in FIG. 5, the video clock (502; 302, FIG. 3) driving the video image formatter (303, FIG. 3) normally follows the reference clock (512; 312, FIG. 3), except when a vdo_stall signal (509; 309, FIG. 3) is received by the clock gating circuitry (321, FIG. 3). The vdo_stall signal (509; 309, FIG. 3) effectively causes a delay in the clocking of the video clock (502; 302 FIG. 3). This delay is desirable and follows a "synthesized" video clock created by the CIPWM (311, FIG. 3) according to the functionality of the CIPWM (311, FIG. 3) as described above.

The preceding description has been presented only to illustrate and describe embodiments of invention. It is not intended to be exhaustive or to limit the invention to any precise form disclosed. Many modifications and variations are possible in light of the above teaching. It is intended that the scope of the invention be defined by the following claims.

What is claimed is:

1. A video processing system for a laser printer, comprising:

a video image formatter;

a clock-independent pulse width modulator; and a clock gating circuit configured to provide a clock signal to said video image formatter based on a stall signal received from said clock-independent pulse width modulator.

2. The video processing system of claim 1, wherein said video image formatter converts raw image data into binary pulse width code and outputs said binary pulse width code to said clock-independent pulse width modulator.

3. The video processing system of claim 2, wherein said video image formatter comprises a video data path controlled by a video control block, wherein said clock signal is provided to said video control block.

4. The video processing system of claim 1, wherein said clock gating circuit receives and stalls a reference clock signal to produce said clock signal.

5. The video processing system of claim 4, wherein said clock gating circuit comprises a D flip-flop and a logic OR gate.

6. The video processing system of claim 4, wherein said reference clock signal is also provided to a control block of said clock-independent pulse width modulator.

7. The video processing system of claim 6, wherein said reference clock signal is also provided to a pulse width modulator of said clock-independent pulse width modulator.

8. The video processing system of claim 1, wherein said clock-independent pulse width modulator comprises a first-in-first-out (FIFO) buffer, a pulse width modulator receiving data from said FIFO buffer, and control block for controlling said FIFO buffer and said pulse width modulator.

9. The video processing system of claim 8, wherein said clock-independent pulse width modulator outputs a modulating signal to a laser.

10. The video processing system of claim 9, further comprising a laser print engine comprising said laser.

11. A clock gating circuit for clocking video processing circuitry, comprising:

an input for receiving a reference clock signal;

an input for receiving a stall signal from a clock-independent pulse width modulator; and a gating circuit configured to alter said reference clock signal in accordance with said stall signal and output a resulting video clock signal for said video processing circuitry.

12. The clock gating circuit of claim 11, wherein said gating circuit comprises a D flip-flop and a logic OR gate.

13. The clock gating circuit of claim 12, wherein:

said D flip-flop receives said stall signal and said reference clock signal and outputs a signal to one input of said OR gate;

said OR gate receives said reference clock and said signal output by said flip-flop and outputs said video clock signal.

14. The clock gating circuit of claim 11, said gating circuit alters said reference clock signal by stalling the reference clock signal.

15. The clock gating circuit of claim 11, wherein said reference clock signal is derived from a system clock of a laser printer.

16. A method of clocking a video processing circuit, said method comprising stalling a reference clock signal based on a stall signal from a clock-independent pulse width modulator to produce a video clock signal for use by an image data processing circuit.

17. The method of claim 16, further comprising:

placing a clock gating circuit between a reference clock and said image data processing circuit; and stalling said reference clock signal with said clock gating circuit.

18. The method of claim 16, further comprising inputting said stall signal to said clock gating circuit with said clock-independent pulse width modulator.

19. The method of claim 16, further comprising stalling said reference clock signal with a D flip-flop and a logic OR gate.

20. The method of claim 19, further comprising:

inputting said stall signal and said reference clock signal to said D flip-flop;

inputting said reference clock and an output of said D flip-flop to said OR gate; and outputting said video clock signal from said OR gate.

21. The method of claim 16, further comprising deriving said reference clock signal from a system clock signal of a laser printer.

22. The method of claim 16, further comprising processing image data with said image data processing circuit according to a timing of said video clock signal.

23. A method of printing comprising:

clocking a video processing circuit by stalling a reference clock signal based on a stall signal from a clock-independent pulse width modulator to produce a video clock signal for use by an image data processing circuit; and processing image data with said image data processing circuit according to a timing of said video clock signal.

24. The method of claim 23, further comprising:

placing a clock gating circuit between a reference clock and said image data processing circuit; and stalling said reference clock signal with said clock gating circuit.

25. The method of claim 23, further comprising inputting said stall signal to said clock gating circuit with clock-independent pulse width modulator.

26. The method of claim 23, further comprising staling said reference clock signal with a D flip-flop and a logic OR gate.

27. The method of claim 26, further comprising:

inputting said stall signal and said reference clock signal to said D flip-flop;

inputting said reference clock and an output of said D flip-flop to said OR gate; and outputting said video clock signal from said OR gate.

28. The method of claim 23, further comprising deriving said reference clock signal from a system clock signal of a laser printer.

29. The method of claim 23, further comprising processing image data with said image processing circuit according to a timing of said video clock signal.

30. The method of claim 23, further comprising:

receiving a binary pulse width code from said image data processing circuit; and producing a modulation signal from said binary pulse width code with said clock-independent pulse width modulator.

31. The method of claim 30, further comprising modulating a laser with said modulation signal to print an image corresponding to said image data.

32. A system for printing comprising:

image data processing means for processing image data; and means for stalling a reference clock signal based on a stall signal from a clock-independent pulse width modulator to produce a video clock signal for use by said image data processing means.

33. The system of claim 32, further comprising means for inputting said stall signal to said clock gating circuit from said clock-independent pulse width modulator.

34. The system of claim 32, wherein:

said means for stalling further comprise a D flip-flop and a logic OR gate;

said D flip-flop receives said stall signal and said reference clock signal and outputs a signal to one input of said OR gate; and said OR gate receives said reference clock and said signal output by said flip-flop and outputs said video clock signal.

35. The system of claim 32, further comprising means for deriving said reference clock signal from a system clock signal of a laser printer.

36. The system of claim 32, wherein said clock-independent pulse width modulator comprises:

means for receiving a binary pulse width code from said image data processing means; and means for producing a modulation signal from said binary pulse width code.

37. The system of claim 36, further comprising means for modulating a laser with said modulation signal to print an image corresponding to said image data.

38. A video processing system for a laser printer comprising:

a video image formatter comprising a video control block; and a clock-independent pulse width modulator configured to output a stall signal based on operation of said clock-independent pulse width modulator.

wherein said video control block is configured to provide a clock signal for said video image formatter based on said stall signal received from said clock-independent pulse width modulator.

39. The video processing system of claim 38, wherein said video image formatter converts raw video image into binary pulse width code and outputs said binary pulse width code to said clock-independent pulse with modulator.

40. The video processing system of claim 39, wherein said video image formatter comprises a video path controlled by said video control block, wherein said clock signal is provided to said data path.

41. The video processing system of claim 38, wherein said clock-independent pulse width modulator comprises a first-in-first-out (FIFO) buffer, a pulse width modulator receiving data from said FIFO buffer, and control block for controlling said FIFO buffer and said pulse width modulator.

42. The video processing system of claim 38, wherein said clock-independent pulse width modulator outputs a modulating signal to a laser.

43. The video processing system of claim 42, further comprising a laser print engine comprising said laser.

* * * * *